United States Patent [19]

Minh

[11] Patent Number: 5,076,588

[45] Date of Patent: Dec. 31, 1991

[54] CARD GAME BASED ON DECISION THEORY

[76] Inventor: Do L. Minh, 17231 Regulus Dr., Yorba Linda, Calif. 92686

[21] Appl. No.: 563,406

[22] Filed: Aug. 6, 1990

[51] Int. Cl.[5] ..... A63F 1/00; A63F 3/00

[52] U.S. Cl. ..... 273/292; 273/249; 273/297

[58] Field of Search ..... 273/245, 247, 94, 297, 273/298, 292, 256, 274

[56] References Cited

U.S. PATENT DOCUMENTS

| | | | |
|---|---|---|---|
| 2,026,082 | 12/1935 | Darrow | 273/134 |
| 2,049,284 | 7/1936 | Anderson | 273/94 R |
| 4,706,959 | 11/1987 | Price | 273/247 |

OTHER PUBLICATIONS

Sport Illustrated Pro Football, Sport Illustrated Magazine, vol. 33, No. 21, pp. 99 and 100, Nov. 23, 1970.

LaValle, I. H., *Fundamentals of Decision Analysis,* Holt, Rinehart and Winston, 1978, pp. 14–15.

Anderson, D. R., Sweeney, D. J. and Williams, T. A., *An Introduction to Management Science,* West Publishing Company, 1989 (5th Edition), pp. 569–592.

*Primary Examiner*—Benjamin Layno

[57] ABSTRACT

The present invention entails a card game comprising a set of cards. Each card bears a plurality of states of nature which can be uniquely realized by a chance device, a plurality of probabilities that each of the state of nature is realized and a plurality of rewarding rules, each of which associates each state of nature with a unique reward. Upon his or her turn, the player is given one such card, studies it, selects one rewarding rule, then performs the chance device and finally receives a reward accordingly.

17 Claims, 3 Drawing Sheets

CARD GAME BASED ON DECISION THEORY

TECHNICAL FIELD

The present invention relates to gaming apparatuses and methods for playing games, more especially to a game requiring players to select one rule amongst many rewarding rules, given that all possible pay-offs associated with each rewarding rule are known.

BACKGROUND OF THE INVENTION

1. Card games and board games have long been a favorite pastime for adults and children alike. Not only are they entertaining, but they also provide the players with the opportunity to get together, to interact in fun and fellowship.

Most of the card games currently available on the market, however, rely primarily on pure chance such as the outcome of tossing a die or of drawing a card from a shuffled deck. The players generally are bound by these outcomes and cannot use their mental ability to exert any control over the pay-offs associated with these random outcomes.

Also, most of the card games currently available are not designed to improve the players' quantitative skills, especially skills in understanding and utilizing probabilities in daily decisions.

Finally, most of the existing card games require the players to retain their cards, and to play only when the time is appropriate. This poorly reflects what happens in real life, where, faced with many decision alternatives, a person normally has to choose one and forgo the rest. For example, because of limited resources and time, a student must decide to study either medicine or law, not medicine then law, nor medicine and law.

2. Decision theory is a well established branch of applied mathematics. In its simplest form, it presents to a decision maker:

(i) a set of decision alternatives, from which he or she must choose one decision;

(ii) a set of states of nature, which are the future random events over which he or she has no control; and (iii) a rule rewarding to said decision maker with a pay-off, depending o which decision is chosen and which state of nature occurs.

Decision theory provides a method for obtaining the most optimal decision.

For example, early each year, a farmer must decide whether to grow peas (decision d1) or asparagus (decision d2). The states of nature consist of the types of weather which might occur during the year; i.e., perfect weather (state s1), variable weather (state s2) or bad weather (state s3). The farmer has no control over the types of weather. The pay-offs, in terms of thousands of dollars, can be determined as in the following hypothetical table:

TABLE 1

| | s1 | s2 | s3 |
|---|---|---|---|
| d1 | 4 | 5 | 8 |
| d2 | 2 | 3 | 12 |

Decision theory represents a serious attempt by scientists to model the "real" world. It is taught at any reputable university-level business school to train students in the art of applying quantitative approaches to decision making. In its simplest form, it can be found in any introductory textbook in Management Science A related field of study is game theory in which there is a conflict between two or more people. Here, the states of nature are not random events but are determined by the other players. In other words, in game theory, a player does not play against any odds as in decision theory, but against his or her best opponents. Poker, tic-tac-toe and chess are of the type studied in game theory; roulette or craps are not.

Game theory is not concerned with inventing any new game rules, but rather analyzes the behavior of a set of players in an existing game. Thus card games found in game theory literature are normally trivial, having no entertainment or commercial value, and are mainly used to demonstrate the game theory concept. One such game, as an example of the two-person, zero-sum game, can be "Two players each has two cards, a "1" or a 37 2". Unknown to his or her opponent, each player selects one card. The selected cards are then compared. If the sum of the numbers on the cards is even, then one player wins that sum from the other player; if odd, then the latter wins from the former."

It is said that mathematician von Neumann developed game theory to study some form of human behavior and economic phenomena after observing the behavior of poker players. The direction of development here is from game to life, not from theory to game.

Similarly, to the best of my knowledge, no card game which is sold commercially as a concrete form of entertainment has been originated from decision theory. As in game theory, whenever the term "game" is used in the decision theory literature, it has a different connotation. (For example, LaValle, I. H., *Fundamentals of Decision Analysis,* Holt, Rinehart and Wilston, 1978, pp.14–15) Even if, with a very slim chance, a game similar the present invention has been discussed somewhere in decision theory literature, it could only have been used to demonstrate some basic concept of the theory or to provide a generic model for discussion. Again, because of its orientation towards serious real life applications, it is unobvious for its author and readers to realize its potential as a gaming apparatus or a method of entertainment

SUMMARY OF THE INVENTION

It is an object of the present invention to provide a novel game apparatus and a novel method for playing a game.

It is an object of the present invention to provide an apparatus and a method for playing a game that reduces the role played by pure chance devices, thereby giving the players more control over the pay-offs.

It is an object of the present invention to provide an apparatus and a method for playing a game that is exciting, stimulating and challenging, in which success depends on a very unique blend of skill, strategy and luck.

It is also an object of the present invention to provide an apparatus and a method for playing a game that is educational, bringing the rudiments of decision theory to any person above the age of 6, sharpening their perception of life in which one normally can only pick one decision amongst many decision alternatives while forgoing the rest.

It is also an object of the present invention to provide an apparatus and a method for playing a game that is educational, introducing the concept of probability to young players, improving their quantitative skill, yet is relatively simple to understand and can be enjoyed any played by all people over the age of 6.

It is also an object of the present invention to provide an apparatus and a method for playing a game that can be used to enhance many games currently available on the market.

Features of the present invention useful in accomplishing the above objects include a set of pay-off cards. Each card bears a plurality of states of nature which can be uniquely realized by a chance device, a plurality of probabilities that each state of nature is realized and a plurality of rewarding rules, each of which associates each state of nature with a unique reward. Upon his or her turn, the player is given one such card, studies it, selects one rewarding rule, then performs the chance device and finally receives a reward accordingly.

The foregoing and other objects of the present invention, as well as the present invention itself and its embodiments, may be more fully understood from the following description, when read in conjunction with the accompanying drawings.

DETAILED DESCRIPTION OF THE INVENTION

Description of the Basic Invention 1.1. In the basic form of a playing apparatus according to the present invention, there is a set of playing pieces of like shape, called for convenience herein "pay-off cards" or simply "cards", each of which has a front and a reverse side.

The reverse sides 10 of all cards are identical with each other and thus indistinguishable from one another.

Figure 1:
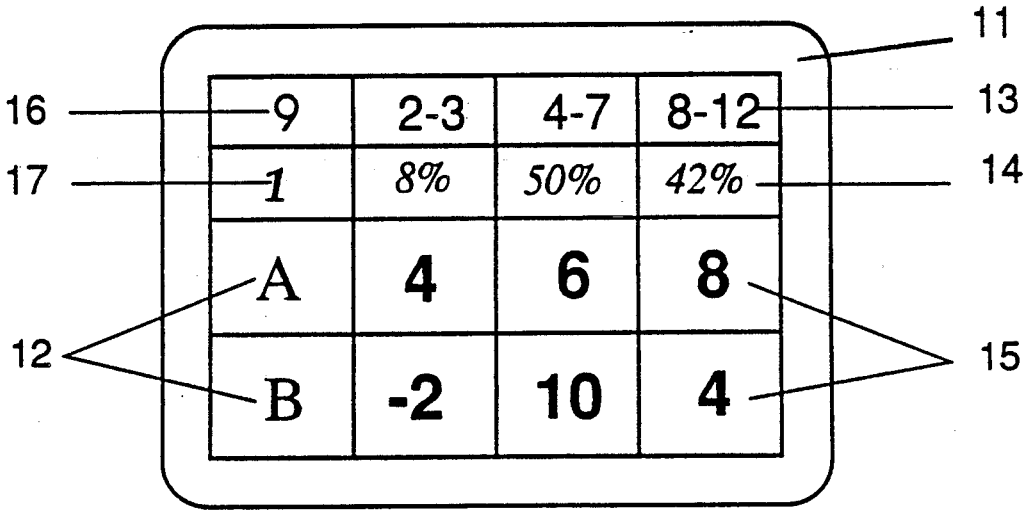
FIG. 1 shows the front side of one of the pay-off cards.

Referring to FIG. 1, there is shown a front side 11 of a sample card, which contains information critical to the playing of the game. The exact design of the front side of each card is not critical and is shown here for example purpose only. Each front side 11 carries a differing combination, comprising:

(i) a plurality of states of nature 13. An example is shown in FIG. 1, where they are three disjoint sub-sets of the set of integers $I=\{2,3,4,5,6,7,8,9,10,11,12\}$. Each subset is denoted by L-U where L the is lower bound or the smallest and U the upper bound or the largest of its members. Thus 2–3, 4–7 and 8–12 stand for the three sub-sets {2,3}, {4,5,6,7} and {8,9,10,11,12} respectively. These states of nature are conveniently arranged in ascending order. The optimal number of the states of nature seems to be two or three; the maximum five.

Since any one of these states of nature can be obtained from the rest, one state of nature can be implied and thus may not be stated explicitly. For example, if only states 2–3 and 4–7 are stated, then state 8–12 is implied.

There is a functional relationship mapping each of the possible outcomes of a chance device to one and only one state of nature, which may an implied one. In other words, each outcome of said chance device uniquely identifies, or realizes, one state of nature. Furthermore, each of these states of nature must be realizable by said chance device; i.e., for each state of nature, there is at least one outcome of said chance device to be mapped into it. In the example shown in FIG. 1, said chance device is a pair of dice 21 dice. The sum resulting from any toss of these two dice uniquely realizes the state of nature having this sum as its element. Also, each state of nature L–U can be realized by any outcome greater than or equal to L and less than or equal to U.

(ii) a probability 14 that a state of nature is realized by the chance device, conveniently put in percentage format. Since these probabilities are functions of the outcomes of a chance device, they can be calculated objectively. If the chance device is a pair of two dice, then the probability that a state of nature L–U is realized can be read from the entry in the row labeled L and in the column labeled U of Table 2.

TABLE 2

| L\U | 2 | 3 | 4 | 5 | 6 | 7 | 8 | 9 | 10 | 11 | 12 |
|---|---|---|---|---|---|---|---|---|---|---|---|
| 2 | 03 | 08 | 17 | 28 | 42 | 58 | 72 | 83 | 92 | 97 | 100 |
| 3 | | 06 | 14 | 25 | 39 | 56 | 69 | 81 | 89 | 94 | 97 |
| 4 | | | 08 | 19 | 33 | 50 | 64 | 75 | 83 | 89 | 92 |
| 5 | | | | 11 | 25 | 42 | 56 | 67 | 75 | 81 | 83 |
| 6 | | | | | 14 | 31 | 44 | 56 | 64 | 69 | 72 |
| 7 | | | | | | 17 | 31 | 42 | 50 | 56 | 58 |
| 8 | | | | | | | 14 | 25 | 33 | 39 | 42 |
| 9 | | | | | | | | 11 | 19 | 25 | 28 |
| 10 | | | | | | | | | 08 | 14 | 17 |
| 11 | | | | | | | | | | 06 | 08 |
| 12 | | | | | | | | | | | 03 |

(iii) a plurality of rewarding rules. Each rule includes an identification 12, conveniently named A, B, . . . and a plurality of pay-offs 15. Each rule uniquely identifies each state of nature with a pay-off 15.

The optimal number of rewarding rules is about two or three, but in no case greater than five. Each player, upon his or her turn, has to select one rule out of these rewarding rules.

The pay-offs can be numbers, directions, colors, clues, letters, etc. . . . In numerical form, they can be of any value but preferably be chosen so that the expected pay-offs of all rules are approximately the same. The expected pay-off of a rule is calculated as the total of the products of all the pay-offs associated with that rule and their respective probabilities. In the example shown in FIG. 1, the expected pay-off for rule A is:

$$(4)\times(0.083)+(6)\times(5)+(8)\times(0.417)=6.67,$$

and for rule B is:

$$(-2)\times(0.083)+(10)\times(0.5)+(4)\times(0.417)=6.55.$$

The pay-off associated with an implied state of nature is normally zero.

Fifty seems to be a reasonable number of pay-off cards in each set.

The playing apparatus further includes a scoring device to register each player's cumulative pay-off. This can simply be a sheet of paper, or a game board 22 having a plurality of positions 23 for the players' movers 24 to traverse in sequential steps from a start position to a finish position, or a plurality of game money 25 or, as in gambling casinos, real money 26.

If there are always two rewarding rules in each card, then the playing apparatus further includes a set of two-sided declaring pieces, each has on one side a letter "A" and on the other side a letter "B". The players use these pieces to declare which rule they select.

1.2. Such playing apparatus is adapted for playing a game in which a player, upon his or her turn, sequentially:

(i) picks a card from a deck of pay-off cards having their reverse side up;

(ii) studies said card and selects one chosen rule amongst the rewarding rules listed therein;

(iii) declares said chosen rules clearly, either verbally or by turning up the appropriate side of a declaring piece;

(iv) obtains an outcome from a chance device, such as by tossing 2 dice, thus obtains a realized state of nature;

(v) receives a reward equal to the pay-off determined by the the chosen rule and the realized state of nature. This can be done by having the cumulative pay-off recorded in the score sheet, or by moving his or her mover to a new position in the game board by a number of positions equal to the pay-off, or by receiving or paying an amount of game money or real money equal to the absolute value of the pay-off depending on whether the pay-off is positive or not;

(vi) discards said card into the discard pile.

1.3. In the basic form of a method of playing a game, the present invention comprises:

(i) establishing a plurality of differing combinations, each including:

a plurality of states of nature, each of which is uniquely realizable by a chance device. One of these states of nature may be implied, thus does not have to be stated explicity. For each state of nature, the probabilities that it is realized can be calculated objectively as a function of the outcomes of said chance device. It is preferable, but not necessary, that this probabilities is stated explicitly; and a plurality of rewarding rules, each of which associates each state of nature with a unique reward.

(ii) randomly selecting one combination out of said plurality of combinations.

(iii) requiring a deciding player to select a chosen rule amongst the rewarding rules included in the combination selected in step (ii);

(iv) obtaining a realized state of nature by obtaining an outcome from said chance device and mapping said outcome into one of the states of nature included in the combination selected in step (ii);

(v) rewarding to a receiving player a reward according to the chosen rule and the realized state of nature. Normally, the receiving player is the deciding player;

(vi) going to step (ii) to start a new turn.

A major novel feature of this method of playing is that, in each turn:

(i) there is more than one rewarding rules;

(ii) the rewarding rules change from one turn to another;

(iii) the players are required to select one rewarding rule;

(iv) a player's selection and a realized state of nature uniquely identifies a pay-off; and (v) the probability that a state of nature is realized is objective and changes from one turn to another.

In games like betting, the players also have to make a guess, or a selection; this selection is then compared with the realized state of nature to determine the reward. Also, the probability that a state of nature is realized changes from "turn" to another. However, the main reason for this change is that these probabilities are subjective, varying not only from one "turn" to another but also from one player to another, even from one second to another, in each turn.

In games like lottery, the probabilities of the states of nature can be determined objectively but normally are presented to the players so that they can decide to play or not, not as an integral part of the game. Once a person decides to play, these probabilities remain constant for some duration of time, thus play a very minor and subordinate role in the player's decision making process. In the present invention, the states of nature and their probabilities keep changing from one turn to another. The players are thus forced to study them constantly.

Also, in the present invention, the number of states of nature are kept small, preferably less than 5. The probabilities are thus not of the order of 1/1,000,000 but of a more realizable 3% or 50%.

It will be appreciated that the form of a method of playing a game in this invention is readily adaptable into other media such as machine, or computer, or television, or for the entertainment of an audience wider than the circle of actual players. For example, currently in California, a person can win a chance for appearing in a televised show to spin a wheel and to be rewarded accordingly. Said person normally feels helpless, not being able to have any control over the pay-off and thus has to subject himself or herself entirely to luck. The present form of playing can be adapted to this kind of televised show to make it more exciting, for example, by first letting said person twice spin a wheel having divisions labeled from 1 to 100, say. Suppose that two numbers 43 and 78 are obtained. Two rewarding rules numbered 43 and 78, together with their states of nature and the corresponding pay-offs, are selected out of a set of 100 rewarding rules and projected into a screen. After the player picks one rewarding rule out of the above two, he or she spins the wheel once more, determining the realized state of nature and hence the pay-off.

1.4.1. The present invention allows the players to have some control over the pay-offs which otherwise depend entirely on the outcomes of a pure chance device. Here, the player's selection of the rewarding rule can make a lot of difference in the pay-off and the outcomes of the chance device thus is reduced to a secondary role.

The present invention thus satisfies the objective of providing an apparatus and a method for playing a game that reduces the role played by pure chance devices, thereby giving the players more control over the pay-offs.

It therefore also satisfies the objective of providing an apparatus and a method for playing a game that is exciting, stimulating and challenging, in which success depends on a very unique blend of skill, strategy and luck.

1.4.2. The present invention satisfies the objective of providing an apparatus and a method for playing a game that is educational, bringing the rudiments of decision theory to any person above the age of 6, sharpening their perception of life in which one normally can only pick one decision amongst many decision alternatives while forgoing the rest. Here, the decision alternatives are the various rewarding rules.

1.4 3. In continuing playing the present invention, a typical young player can develop his or her quantitative skill through many levels:

(i) in the least sophisticated level, a player between 6 and 8 year old simply picks a rewarding rule that gives the highest pay-off in the whole card, regardless of its probability In the example shown in FIG. 1, this is rewarding rule B, because it gives a pay-off of 10, the highest in the whole card. This is known as the Maximax criterion;

(ii) after a while, the player must realize that there are better criteria. One of these, more conservative than Maximax, is known as the Maximin criterion in which the player identifies the minimum pay-off for each rewarding rule and picks a rewarding rule that maximizes these minima. In the example shown in FIG. 1, the minimum pay-off for rewarding rule A is 4 and for rewarding rule B is −2; rewarding rule A is thus chosen because it has the highest minimum pay-off.

(iii) the player eventually realizes the importance of the probabilities and starts selecting rewarding rules based on the "weight" of each state of nature.

The present invention thus satisfies the objective of providing an apparatus and a method for playing a game that is educational, introducing the concept of probability to young players, improving their quantitative skill, yet is relatively simple to understand and can be enjoyed and played by all people over the age of 6.

1.4.4. The present invention can also be adapted to enhance many games currently available on the market. Consider, for example, the famous game of Monopoly, a copyrighted game of Parker Brothers, U.S. Pat. No. 2,026,082. While this game requires substantial decision making skill in the buying and selling of real estate, it has two sets of Chance and Community Chest cards which are dependent entirely on pure chance. If a set of pay-off cards is used in their place, the chance element of the game is further reduced, making the game more challenging and stimulating.

The present invention thus satisfies the objective of providing an apparatus and a method for playing a game that can be used to enhance many games currently available on the market.

Description of Preferred Form I of the Game Apparatus

Preferred form I of the game apparatus relates to a game board 22 having a path comprising of a plurality of position 23 to be traversed by players' movers 24 in sequential steps from a start position to a finish position. In some positions, instructions such as "Go back 5 steps" or "Go forwards 3 steps" are printed. Furthermore, no two movers are allowed to occupy the same position If John's mover moves to a position already occupied by Mary's, then Mary's mover must move backwards by a predetermined number of positions; if this new position is also occupied, then Mary's mover has to move back further by another predetermined amount, until it can find a vacant position.

Preferred form I thus changes the rewards from the face values of the pay-offs printed in the card, requiring the players to study the entire situation in the game board, rather than just the pay-off cards. Since the expected rewards of all rewarding rules are no longer approximately the same, this further encourages the players to pay attention to the probabilities. This also stimulates interaction among the players.

This preferred form I is also an example of the application of the basic form of the present invention to existing games to make it more interesting.

Description of Preferred Form II of the Game Apparatus

In preferred form II of the game apparatus, each pay-off card further includes a variate 16 simulating the outcome of the two dice.

If, in every stack of 36 pay-off cards, 1 randomly chosen card bears a variate equal to 2, 2 bear 3, 3 bear 4, 4 bear 5, 5 bear 6, 6 bear 7, 5 bear 8, 4 bear 9, 3 bear 10, 2 bear 11 and 1 bears 12, then a variate 16 read from a randomly selected pay-off card has the same distribution as that of a sum of the two dice.

Now, after a player has made his or her selection of a rewarding rule, a new pay-off card is drawn. However, before this new card is given to the other player, its variate 16 is used to determine the pay-off for the previous player.

Note that, in this form, the probabilities of the states of nature in a card might have to be changed slightly, conditioning on the value of the variate printed in that card.

Also, the probability that a particular variate appears depends on the variates already appeared and now belonging to the discard pile. If a player remembers which variates have already appeared, he or she can have a better estimation of the probabilities of the states of nature.

While this form reduces the cost of the dice and of packaging, it might take away the player's sensation in tossing the two dice.

Description of Preferred Form III of the Game Apparatus

In preferred form III of the game apparatus, each pay-off card further includes a value of sample information 17. This is the value a player has to pay for the privilege of tossing one die first, then selecting a rewarding rule, then tossing the second die to determine the pay-off based on the sum of the two dice. Using this privilege, the player will receive a reward equal to the pay-off minus this value of sample information 17.

The outcome of the first toss is known as the sample information; after this toss, the probabilities of the states of nature are no-longer the same as those stated in the card but change to what known as the posterior probabilities. Consider, for example, the pay-off card shown in FIG. 2. If a player tosses one die first and obtains a "1"; i.e., if the sample information is "1", then the probability that the state of nature 10–12 is realized is no-longer 17% but becomes the posterior probability 0%, suggesting the player to select rewarding rule B; on the other hand, if the sample information is "6", then the posterior probability of the state of nature 2–4 is zero and rewarding rule A would be chosen. Thus the sample information could help the player to make a better selection, resulting in a higher reward.

Standard decision theory helps one to calculate the expected value of the difference in the pay-offs of the best selection with and without the sample information. This amount, round-off to a nearest integer higher than it, is the value of sample information 17.

In the above example, if the sample information is "1", then it can be seen that the posterior probabilities of states of nature 2–4, 5–9 and 10–12 are 0.5, 0.5, and 0 respectively. Given that the sample information is "1", the conditional expected pay-off for a player who always picks a rewarding rule having the highest expected pay-off is the maximum of:

$$(-20)\times(0.5)+(7)\times(0.5)+(25)\times(0)$$

and $$(0)\times(0.5)+(7)\times(0.5)+(5)\times(0)),$$

which is 3.5. Similarly, given that the sample information is "2", "3", "4", "5" or "6", then the conditional expected pay-off is 4.66, 5.33, 10, 13 or 16 respectively. As the probability that a sample information is equal to 1, 2, 3, 4, 5 or 6 is 1/6, the expected pay-off with sample information is:

$$(3.5+4.66+5.33+10+13+16)/6=8.75.$$

The expected pay-off without the sample information is the maximum of the expected pay-offs of all rewarding rules; i.e., the maximum of $$(-20)\times(0.17)+(7)\times(0.66)+(25)\times(0.17)$$

and $$(0)\times(0.17)+(7\ )\times(0.66)+(5)\times(0.17)),$$

which is 5.5.

Figure 2:
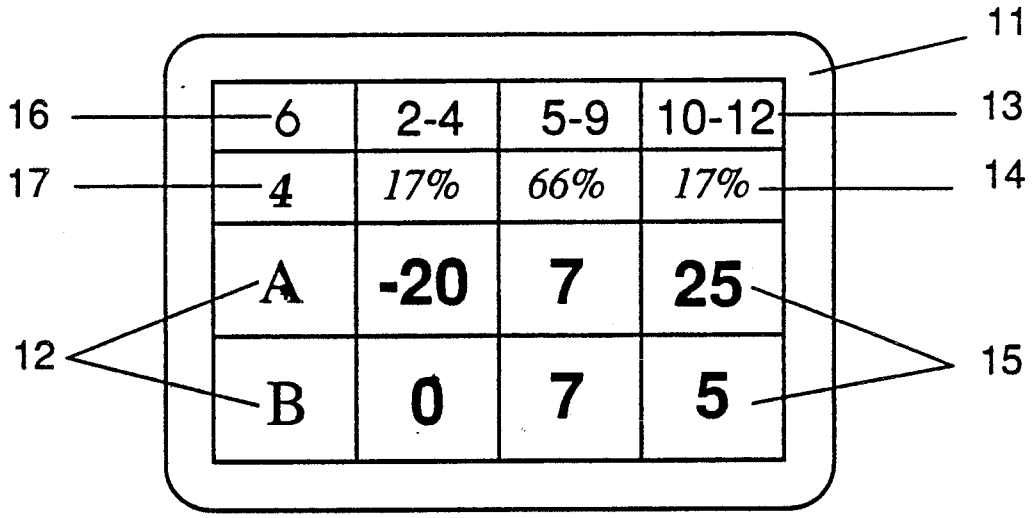
FIG. 2 shows the front side of another, different pay-off card.

The value of sample information 17 for the card shown in FIG. 2 is thus 4, which is the nearest integer higher than (8.75–5.5).

This preferred form III further reduces the role of pure chance and makes the games more challenging and stimulating.

Description of Preferred Form IV of the Game Apparatus

Figure 3:
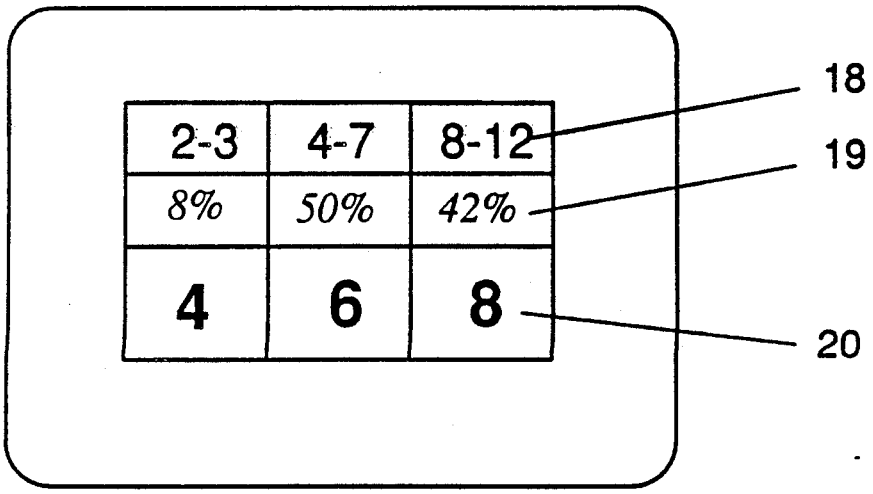
FIG. 3 shows the front side of a pay-off card according to the preferred form IV of the game apparatus.

Preferred form IV of the game apparatus is shown in FIG. 3 in which each card only carries a plurality of states of nature 18, their probabilities 19 and the corresponding pay-offs 20. Upon his or her turn, a player is given a plurality of such cards, then must select one card and discard the rest. The reward is the pay-off according to the realized state of nature in this card. This form has been alluded to in the above example of the televised game where two rewarding rules numbered 43 and 78 are randomly selected from a set of 100 rewarding rules.

Figure 4:
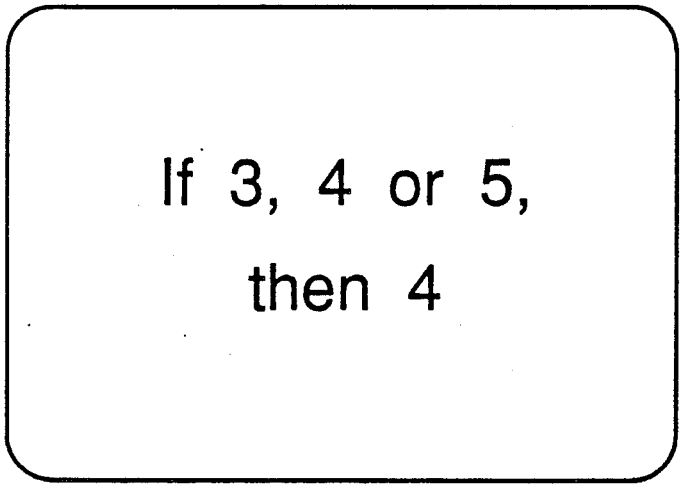
FIG. 4 shows the front side of another, different pay-off card according to the preferred form IV of the game apparatus.
Figure 5:
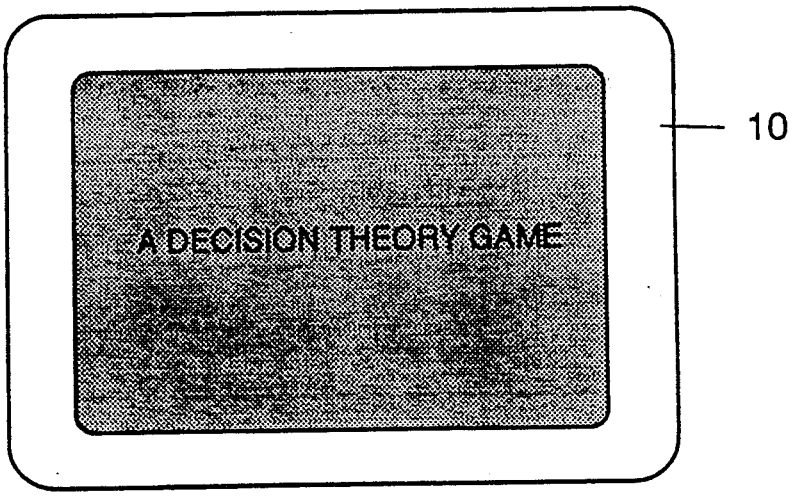
FIG. 5 shows the reverse side of the pay-off cards.
Figure 6:
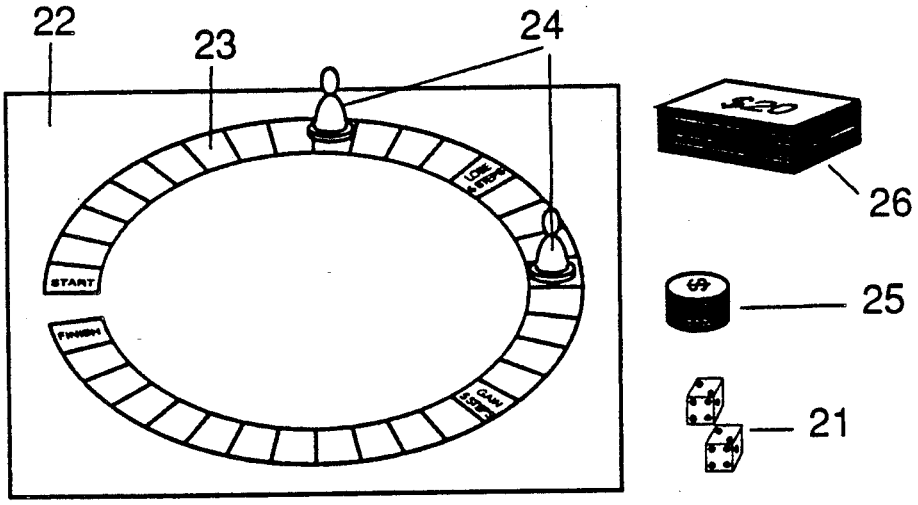
FIG. 6 shows the game board, the dice, play money and real money.

The cards can be as simple as the one shown in FIG. 4, where the state of nature {2,6,7,8,9,10,11,12} is implied. The pay-off associated with this implied state of nature is zero.

The advantage of this form is that more combinations of rewarding rules can be achieved by the same number of cards. Also, by retaining one card and discarding the rest, the player's selection is clearly communicated and remembered. The disadvantage is that the value of sample information is impossible to determine.

Description of Preferred Form I of the Method of Playing

In the preferred form I of the method of playing, each card is auctioned amongst the players. The highest bidding player will be the deciding and the receiving player.

Each players thus has to assess the value of each card: If one bids too low, he or she will be over-bid, losing the opportunity; if one bids too high, he or she will have to pay too much.

This form is particularly suitable in gambling casino, where the expected pay off is printed in the card as the minimum bid allowable.

Description of Preferred Form II of the Method of Playing

In the preferred form II of the method of playing, the deciding player can give the negative value of his or her pay-off to any other player. For example, John picks a card as shown in FIG. 1, then gives to Mary and says: "Mary, rule B is for you." If John tosses two dice and obtains a "8", then Mary will receive a pay-off of −4; if John obtains a "3", then Mary will receive a pay-off of 2.

This tactic can be used by any player, or by a team of players, to "get" one particular player, especially the leading player.

Each player should remember that this tactic can "back-fire." In the above example, Mary can receive a pay-off of 2, rather than losing. Furthermore, the player using this tactic has to pay not only for his or her bid, if applicable, but also for the "opportunity cost" of not receiving a reward.

Description of Preferred Form III of the Method of Playing

In the preferred form III of the method of playing, after a pay-off card is turned up, each of the players selects a rewarding rule and after a state of nature is realized, each receives a reward according to his or her choice This form is particularly suitable in gambling casino, where, in each turn, the players must pay a predetermined amount to be able to play.

Description of the Most Preferred Form of the Game Apparatus

The most preferred form of the game apparatus adapts many interesting features of Monopoly, a copyrighted trademark of Parker Brothers. It includes a banker, a plurality of paper money and a game board having paths comprising many positions to be traversed in sequential steps. These paths forms a continuous loop, having no termination or winning position and only serve to afford a track for the continuity of play.

At the beginning of each game, the banker distributes the same amount of paper money to all players. Each player initially has one mover, or playing piece.

In each turn of play, there are a main player, a deciding player and a receiving player. The players take turn to be the main player. Each turn begins by having all players bid for the right to be the deciding player and thus, by default, the receiving player as described in the Preferred Form I of the method of playing. The deciding player is allowed to designate another player to be the receiving player, to receive a negative value of his or her pay-off, as described in Preferred Form II of the method of playing. The deciding player also has the option of buying sample information, as described in Preferred Form III of game apparatus.

After the deciding player selects a rewarding rule, the main player tosses the two dice to determine the amount of money to be given to the bank by the receiving player or to be paid by the bank to the receiving player, according to that rewarding rule. The main player must also advance his mover to a new position by a number of positions equal to the sum of the two dice.

Players can keep money as a liquid form of paper money or, when permitted, can convert it into real estate equity by buying positions on the game board. The positions then can be rented out, bringing in additional money to its owner. Furthermore, whenever a player's mover passes over or visits his or her own position, then he or she will be awarded a pre-determined amount of money by the banker.

Players can also use their money to buy extra movers. The more movers one owns, the more options one has in deciding which mover to be moved when he or she becomes the main player. The player thus can avoid paying rent and improve his or her chance to pass over or visit his or her own position.

Real estate equity and movers can be converted back into paper money by auctioned to all players, or by selling back to the banker for a predetermined proportion of the original buying price. This, however, can only be done when the player is the main player.

The player therefore must decide how much money to keep in liquid form and how much to invest in real estate or movers. The paper money must be available for:

(i) bidding for being the deciding player. A player can only bid up to what he or she has in liquid form; or (ii) paying rent, if his or her mover lands into a position owned by other player; or (iii) paying fines, if instructed.

If a main player does not have enough paper money to pay fine or rent, then one of his or her positions, or extra movers, must be auctioned or sold back to the banker. If he or she does not own any position or any extra mover, then must leave the game.

The game ends after a predetermined period of time or after a predetermined number of players have to leave. The player having the highest amount of money, in paper, in real estate and in movers, wins.

While the principles of the invention have now been made clear in the illustrated embodiments, there will be obvious to those skilled in the art many modifications of structure, arrangements, proportions, elements, materials, and components used in the practice of the invention, without departing from those principles. The appended claims are therefore intended to cover and embrace such modifications within the limits only of the true spirit and scope of the invention.

I claim as my invention:

1. An apparatus for game playing or gambling comprising a set of symbols, each symbol in said set being visually distinguishable, each symbol in said set being uniquely realizable by a chance device, a plurality of rewarding rules, said set of symbols corresponding to each rewarding rule being divided and grouped into a plurality of subsets wherein each symbol corresponding to any one rewarding rule being grouped into a particular subset corresponding to said rewarding rule, two of said rewarding rules being associated with different subsets, wherein the groups of symbols in the subsets corresponding to a rewarding rule being not all identical to the groups of symbols in the subsets corresponding to another rewarding rule, each rewarding rule having a corresponding reward for each subset corresponding to said rewarding rule, wherein the reward of one subset is distinguishable from the reward of another subset, presenting means for presenting said rewarding rules to a player.

2. Apparatus according to claim 1 wherein the probability of each of said subsets corresponding to each of said rewarding rules being realized by said chance device is objective.

3. Apparatus according to claim 1 further including a probability realized by said chance device for each of said subsets corresponding to each of said rewarding rules.

4. Apparatus according to claim 1 wherein said presenting means includes a plurality of playing pieces, each of said playing pieces bearing at least one of said rewarding rules, each of said playing pieces being of like shape, each having a front side and a reverse side, said reverse side each bearing of a like appearance.

5. Apparatus according to claim 4 wherein said chance device includes a plurality of variates, each of said playing pieces bearing one of said variates.

6. Apparatus according to claim 1 wherein said chance device includes a pair of dice.

7. Apparatus according to claim 1 further including a plurality of movers; and a game board having a path comprising a plurality of positions to be traversed by said movers.

8. Apparatus according to claim 7 further including a plurality of game money.

9. Apparatus according to claim 1 further including a plurality of game money.

10. A method of playing games or gambling comprising the following steps:

(i) providing a set of symbols, each symbol in said set being visually distinguishable, each symbol in said set being uniquely realizable by a chance device, providing a plurality of rewarding rules, said set of symbols corresponding to each rewarding rule being divided and grouped into a plurality of subsets wherein each symbol corresponding to any one rewarding rule being grouped into a particular subset corresponding to said rewarding rule, each rewarding rule having a corresponding reward for each subset corresponding to said rewarding rule;

(ii) selecting at least two different rewarding rules out of said plurality of rewarding rules wherein the rewards of one reward rule are not identical to the rewards of other rewarding rule;

(iii) requiring a deciding player to pick a chosen rule amongst the rewarding rules selected in step (ii);

(iv) obtaining a realized symbol by operating said chance device and identifying a realized subset amongst the subsets corresponding to said chosen rule by said realized symbol;

(v) rewarding a receiving player the reward for said realized subset corresponding to said chosen rule;

(vi) going to step (ii).

11. Method of claim 10 wherein the probability of each of said subsets corresponding to each of said rewarding rules being realized by said chance device is objective.

12. Method of claim 10 further providing a probability realized by said chance device for each of the subsets corresponding to the rewarding rules selected in step (ii).

13. Method of claim 10 further including allowing said receiving player to deduct said reward by a value of sample information, and allowing said deciding player to obtain partial information about said realized symbol after step (ii) and before step (iii).

14. Method of claim 10 further including selecting said deciding player by auction.

15. In a game having a chance device, said chance device determining an original reward awarded to a player, the improvement comprising a set of symbols, each symbol in said set being visually distinguishable, each symbol in said set being uniquely realizable by a chance device, a plurality of rewarding rules, said set of symbols corresponding to each rewarding rule being divided and grouped into a plurality of subsets wherein each symbol corresponding to any one rewarding rule being grouped into a particular subset corresponding to said rewarding rule, each rewarding rule having a corresponding new reward for each subset corresponding to said rewarding rule, whereby one of said new rewards is awarded to said player instead of said original reward, presenting means for presenting said rewarding rules to said player.

16. Improvement according to claim 15 further including a probability realized by said chance device for each of said subsets corresponding to each of said rewarding rules to said player.

17. Apparatus according to claim 15 wherein said presenting means includes a plurality of playing pieces, each of said playing pieces bearing at least one of said rewarding rules, each of said playing piece being of like shape, each having a front side and a reverse side, said reverse side each bearing of a like appearance.

* * * * *